United States Patent [19]

Turnbull

[11] Patent Number: 4,509,923

[45] Date of Patent: Apr. 9, 1985

[54] MARINE JET PROPULSION UNITS

[75] Inventor: Robert S. Turnbull, Christchurch, New Zealand

[73] Assignee: C.W.F. Hamilton & Company Limited, Christchurch, New Zealand

[21] Appl. No.: 320,149

[22] Filed: Nov. 10, 1981

[30] Foreign Application Priority Data

Dec. 9, 1980 [NZ] New Zealand ..... 195791

[51] Int. Cl.[3] ..... B63H 11/10

[52] U.S. Cl. ..... 440/43; 239/265.33; 239/265.35; 440/40; 440/41

[58] Field of Search ..... 440/40–43, 440/38; 114/150–151; 239/265.19, 265.33, 265.35, 265.37; 60/221, 228, 229, 230

[56] References Cited

U.S. PATENT DOCUMENTS

| | | | |
|---|---|---|---|
| 1,572,812 | 2/1926 | Rees | 440/41 |
| 3,030,909 | 4/1962 | Barnes et al. | 239/265.19 |
| 3,114,239 | 12/1963 | Aylor | 440/41 |
| 3,192,715 | 7/1965 | Engel et al. | 114/151 |
| 3,837,578 | 9/1974 | Leibach | 239/265.35 |
| 3,942,464 | 3/1976 | Schoel | 114/151 |
| 4,004,541 | 1/1977 | Onal | 440/41 |

FOREIGN PATENT DOCUMENTS

| | | | |
|---|---|---|---|
| 232049 | 3/1969 | U.S.S.R. | 440/43 |

*Primary Examiner*—Trygve M. Blix
*Assistant Examiner*—Thomas J. Brahan
*Attorney, Agent, or Firm*—Ladas & Parry

[57] ABSTRACT

Hydraulic jet propulsion apparatus having steering deflectors which are hydraulically balanced which operate against a seal to reduce spillage and to reduce jamming ans which will provide a smooth contour for the flow of water while not restricting the cross-sectional area of the jet stream. The apparatus also provides a reversing duct which is operable to intercept the jetstream, downstream of the steering deflectors so that the jetstream is divided into two streams the relative proportions of which depend upon the operation of the steering means each stream being turned while in the duct through an angle in excess of 90 degrees to emerge in diagonal directions respectively forward-to-port and forward-to-starboard so as to produce a reverse thrust with steering dependant on the relative proportions of flow in the two streams.

7 Claims, 18 Drawing Figures

MARINE JET PROPULSION UNITS

This invention relates to hydraulic jet propulsion apparatus suitable for waterborne vessels and in particular to steering and reversing devices associated with such apparatus. Such apparatus customarily includes a pumping means adapted to draw in water and to discharge it as a jetstream from a discharge nozzle in a substantially horizontal direction.

BACKGROUND TO INVENTION

Steering for such hydraulic jet propulsion units is commonly effected by swivelling the discharge nozzle or by deflecting the jetstream by a rudder or by deflectors. Reversing is commonly effected by diverting the water so that it issues from one or more forward facing nozzles or by deflecting the jetstream so that it is turned by substantially more than 90° or by reversing the pumping means so as to reverse the flow of water. A neutral condition is commonly brought about by partial operation of the reversing means or by stopping the operation of the pumping means.

Known steering means and known reversing means commonly associated with hydraulic jet propulsion apparatus suffer from one or more of the following deficiencies:

(1) Excessive mechanical work is required to turn the jetstream through the necessary angle for steering. This may be caused by an unbalance of hydraulic forces exerted on the steering means.

(2) The steering means is liable to jamming by debris which may pass through the jet propulsion apparatus.

(3) Operation of the steering means reduces the propulsive efficiency of the apparatus. This may be caused by restriction of the cross-sectional area of the jetstream or by spillage such that a proportion of the flow of water flows in a direction contrary to the main stream or by turbulence created by the steering means.

(4) The reverse thrust provided is inadequate to effectively control the vessel. This may be caused by inefficient turning of the jetstream or by spillage from a deflector device or by the inefficiency of the pumping means when operated with reverse rotation.

(5) Steering is not effective in the neutral or in the reverse modes. This may be through lack of any provision for steering in one or both of these modes.

(6) In the reversing mode a stream of water (or streams of water) flowing forwardly under the vessel carry entrained air which in turn is sucked into the pump of the propulsion apparatus and reduces the capacity of the pump to discharge water. This reduces the effectiveness of the reversing means and causes an unnecessary increase in engine r.p.m.

THE PRESENT INVENTION

It is an object of this invention to provide improved steering means and to provide improved reversing means for hydraulic jet propulsion apparatus suitable for waterborne vessels.

More specifically it is intended to provide steering deflectors which will be hydraulically balanced, which will operate against a seal to reduce spillage and to reduce jamming, which will provide a smooth contour for the flow of water and which will not restrict the cross-section area of the jetstream.

It is also more specifically intended to provide a reversing duct which is operable to intercept the jetstream, downstream of a steering means, so that the jetstream is divided into two streams the relative proportions of which depends upon the operation of the steering means, each stream being turned, while in the duct, through an angle in excess of 90 degrees in an efficient manner so as to emerge in diagonal directions respectively forward-to-port and forward-to-starboard so as to produce a reverse thrust with steering dependant on the relative proportions of flow in the two streams.

It will be understood that the descriptive terms forward, aft, upstream, downstream, vertical and horizontal as used in this specification are approximate descriptions which apply to the more common use of hydraulic jet propulsion apparatus where it is the main propulsion of the vessel in which it is installed so that the jetstream emerges in an aft direction to propel the vessel forward. Such apparatus may be used for example, as auxiliary propulsion, so as to provide its main thrust sideways or rearwards on the vessel. Furthermore hydraulic jet propulsion apparatus may be installed in a vessel in a manner such that the jetstream emerges with a downward component of velocity or an upward component of velocity so as to produce an upward or a downward component of thrust or so as to simplify installation in the vessel. In all such cases the descriptive terms given above must be interpreted in relation to its more common use as main propulsion in a vessel.

Where specific integers are mentioned herein which have known equivalents in the art to which this invention relates, such known equivalents are deemed to be incorporated herein as if individually set forth.

DRAWING DESCRIPTION

One preferred form of the invention is represented in the following drawing in which:

FIGS. 1*a* and 1*b* are diagramatic sketchs showing in side elevation two different forms of hydraulic jet propulsion apparatus 20,21 installed in vessels 22, 23 but without associated steering or reversing means, FIGS. 2*a* to 2*i* inclusive are diagramatic sketches of the operation of steering means and reversing means in accordance with this invention and in particular FIGS. 2*a*, 2*b* and 2*c* are plan representations illustrating respectively the operation of the steering means when the vessel is moving straight ahead, turning to starboard and turning to port, FIGS. 2*d*, 2*e* and 2*f* are side elevation representations illustrating respectively the operation of the reversing means in the straight ahead mode in the neutral mode and in the reverse mode, and FIGS. 2*g*, 2*h* and 2*i* are plan representations illustrating respectively the operating of the steering and reversing means when in the reverse mode without turning, turning clockwise and turning anticlockwise, FIG. 3 is a sketch showing in side elevation the aft end of a hydraulic jet propulsion apparatus with steering means and reversing means, FIG. 4 is a sketch showing in plan the aft end of a hydraulic jet propulsion apparatus with steering means and reversing means, FIG. 5 is a sketch showing in end elevation looking forward, the aft end of a hydraulic jet propulsion apparatus with steering means, FIG. 6 is a sketch showing in end elevation looking aft a reverse duct, and FIG. 7 is a sketch showing in section a reverse duct.

PREFERRED EMBODIMENT

Figure 1A:
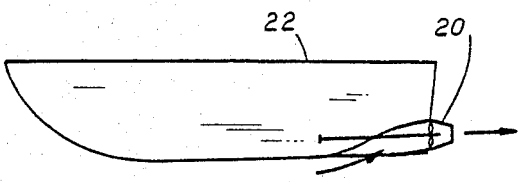
Figure 1B:
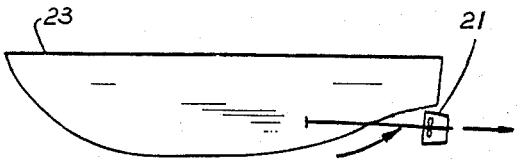
Figure 2A:
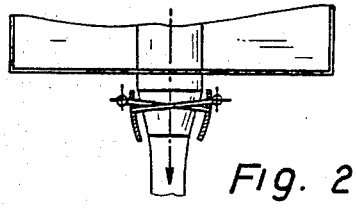
Figure 2B:
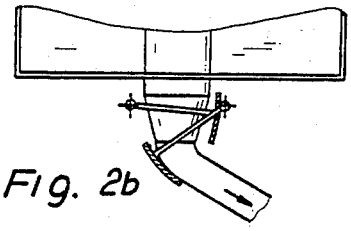
Figure 2C:
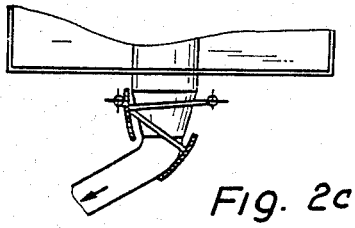
Figure 2D:
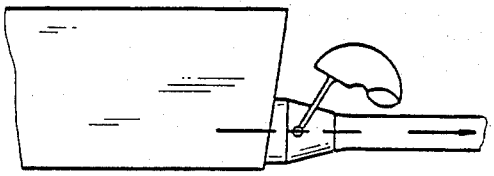
Figure 2E:
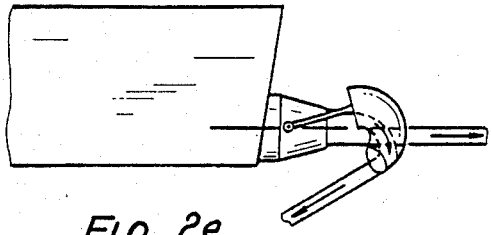
Figure 2F:
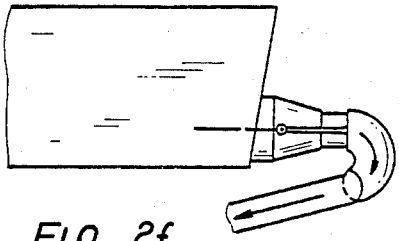
Figure 2G:
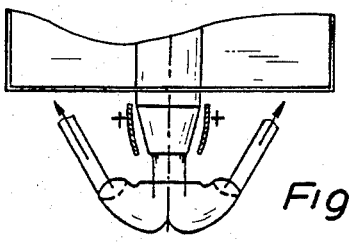
Figure 2H:
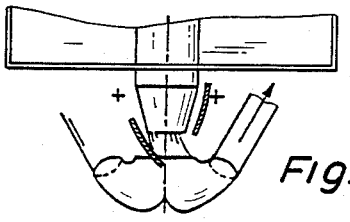
Figure 2I:
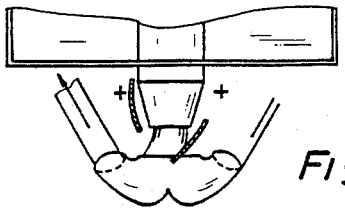
Figure 3:
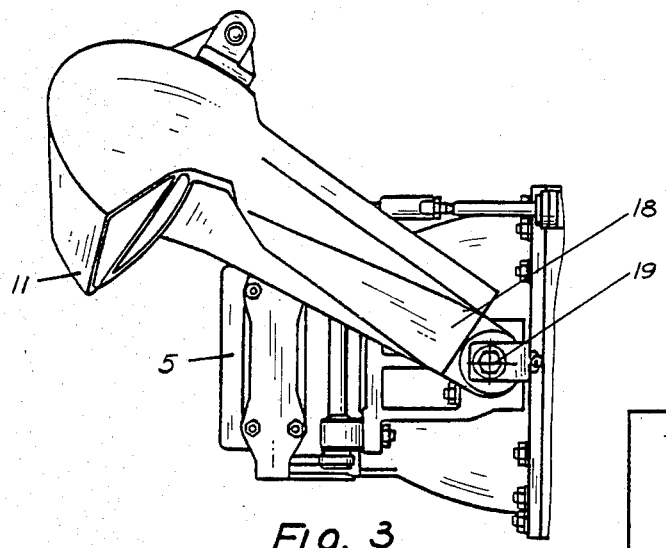
Figure 5:
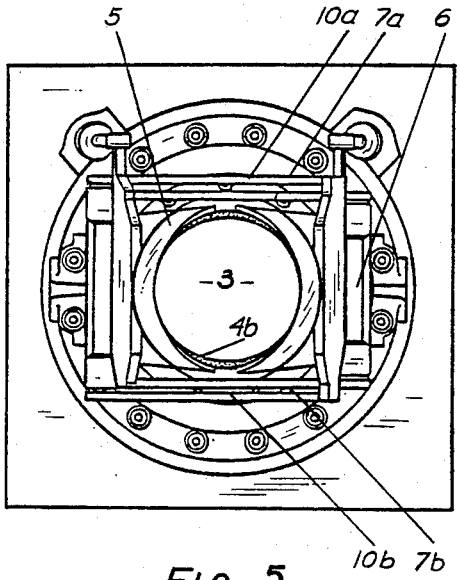
Figure 4:
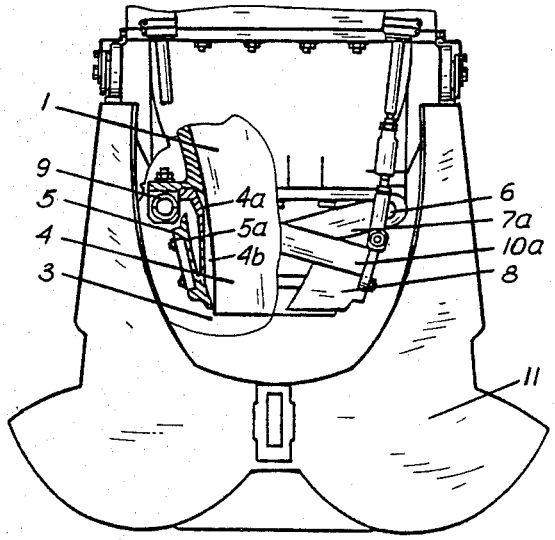

The hydraulic jet propulsion apparatus 20 has a pump which draws in water and discharges it through passage 1 to the discharge nozzle 4 which consists of a rigid casing 4(*a*) and a flexible liner 4(*b*) from which the water emerges as a jetstream in region 3. The flexible liner 4(*b*) in this preferred fom is made of rubber bonded to the rigid casing 4(*a*) and is moulded with a smooth internal contour so as to form the jetstream with minimum turbulence. The extension of the liner 4(*b*) downstream of the rigid casing 4(*a*) is thinned to make it flexible.

One steering deflector 5 has an inner surface 5(*a*) which is a surface of revolution about the pivot 6; the pair of arms 7(*a*) and 7(*b*) carry the steering deflector 5 from the pivot 6. When the steering deflector 5 is moved rearwardly into the jetstream the jetstream is deflected to starboard thus turning the vessel clockwise. At this time the rearward extension of the flexible liner 4(*b*) forms a seal against the inner surface 5(*a*) of the steering deflector which prevents spillage of the jetstream between the rigid casing 4(*a*) and the steering deflector 5. This action reduces losses in propulsive thrust and reduces the tendency for debris to jam the steering deflector.

The opposite steering deflector is similar, it is shown as No. 8 and is carried on arms 10(*a*) and 10(*b*) from a pivot shaft carried in bearing 9.

The discharge nozzle 4 and hence the jetstream in region 3 are shown in this preferred form of the invention as being of circular cross-section but other shapes such as eliptical or rectangular or hexagonal could be used.

The surface of revolution 5(*a*) of the steering deflector 5 has a shape in radial cross-section which is nearly the same as the shape of the discharge nozzle so as to allow a smooth contact with the downstream lip of the flexible liner 4(*b*) when steering. The steering deflector in this preferred form is shaped to envelop as much of the circumference of the jetstream as possible consistent with non-interference with the other steering deflector 8. In practice the steering deflector can envelop approximately half the circumference of the jetstream.

It will be seen that in the preferred embodiment described, the principal hydraulic forces which act normal to the inner surface 5(*a*) of the steering deflector 5 act through the pivot 6 because this pivot is also the centre of revolution of the surface. This construction provides a nominal balance of the steering forces but there is a secondary force parallel to the surface and in the direction of water flow caused by friction. This secondary force tends to move the deflector further into engagement with the jetstream. It has been found desirable to provide a balance for this secondary force and to provide a small amount of self centering in the steering device. This can be achieved in part by placing the centre of revolution of the surface 5(*a*) a small distance in the downstream direction from the pivot 6 so that the normal hydraulic forces produce a small moment tending to move the steering deflector out of the jetstream.

In the preferred embodiment the reversing duct 11 is shown carried on arms 18 from a horizontal pivot 19 and may be moved upward to clear the jetstream or partly down so as to partly intercept the jetstream or down so as to intercept the jetstream. The reversing duct 11 is divided about a central web 12 to extend in opposite directions in two sections 13 and 14. Each section 13 and 14 forms a passage through which part of the jetstream can flow when the reversing duct is in operation. In the preferred embodiment shown each passage is divided by a wall 15(*a*) 15(*b*) into channels 16(*a*) 16(*b*) and 17(*a*) 17(*b*). The dividing wall 15(*a*) 15(*b*) assists in turning the stream efficiently and in guiding the final discharge of the stream but it is envisaged that in other forms of construction there may be no dividing wall or there may be more than one dividing wall in each passage or the dividing wall or walls may be abbreviated in length.

In the preferred embodiment of the invention each channel 16(*a*) 16(*b*) and 17(*a*) 17(*b*) is of substantially uniform crosssection area throughout its length.

In operation it has been found that less air is entrained with the reversing duct as described than with a deflector reversing device and the more uniform direction of each stream of water carries substantially all the entrained air out to either side of the pump intake thus improving the pump efficiency and improving the reverse thrust.

Figure 6:
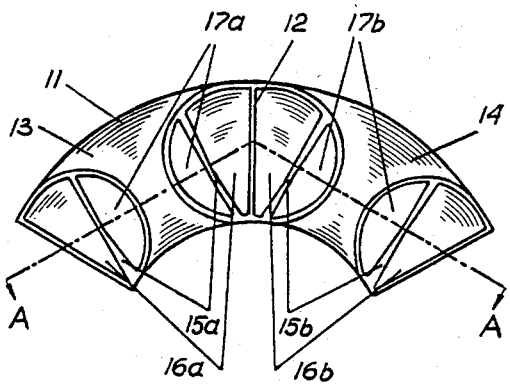
Figure 7:
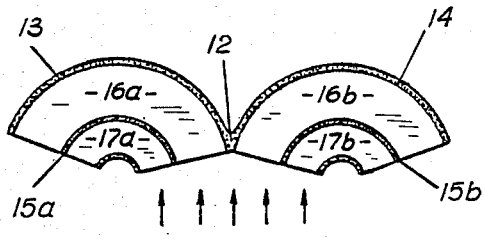

By reference to FIG. 6 it will be seen that, when the reversing duct is in full operation the jetstream is divided into equal parts by the dividing web 12, but that operation of the steering deflector can augment the flow in one passage or the other and hence provide a steering force when in the reverse mode. It can also be seen that, when the reversing duct is in a neutral position such that it intercepts part of the jetstream, the remainder continuing aft under the reverse duct, operation of the steering deflector still provides a steering force. The sense of the steering turning the vessel clockwise or anticlockwise is unchanged whether the reverse duct is in the full reverse, the neutral or the forward (i.e. out of operation) position.

In the preferred embodiment of the invention the reverse duct is pivotally mounted but it is envisaged that in some applications it may be more convenient to carry the reverse duct on a slide means or on multiple linkage means.

Certain advantages may be achieved by using a mechanical or hydraulic device arranged to actuate either steering deflector by use of two push-rods, one to each steering deflector and preferably passing through water seals in the transom of the vessel so that the actuating device may be mounted inboard.

It will be apparent from the description of the steering means given herebefore that the two steering deflectors need not be moved simultaneously. To steer one deflector is moved into the path of the jetstream while the other remains stationary (or nearly stationary) and clear of the jetstream (or nearly clear of the jetstream).

Broadly this consists of an either/or mechanism suitable for use in association with steering means for hydraulic jet propulsion apparatus of the type that has two steering deflectors each operable to deflect the jetstream emerging from the discharge nozzle in an opposite sense, such mechanism incorporating a guide plate which carries a steering lever, such guide plate having two separated pivot points and two intersecting arcuate profiles each centered on a pivot point, each pivot point being the centre of the rounded end of a slot in the guide plate, said steering lever having two pivot pins adapted such that they will simultaneously lie in the said rounded ends of the slots when the steering lever is in its central position, a guide roller attached to said steering lever and adapted so as to engage one or other of the arcuate profiles when the steering lever is moved pivotally about one or other of the pivot points away from its central position, said steering lever having attachment points for push-rods adjacent to the said pivot pins and push-rods adapted to operate the steering deflectors.

It is envisaged that in some constructions a suitably shaped guide block could be used in place of the above-mentioned guide roller.

Figure 8:
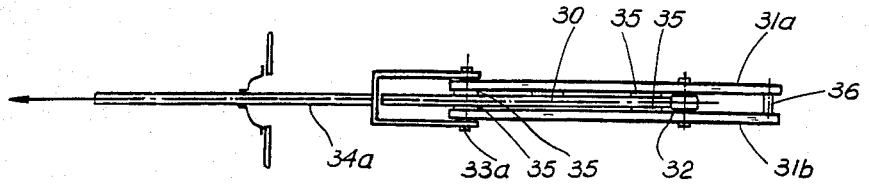
FIG. 8 is a sectional view showing the steering deflector either/or operating mechanism.
Figure 9:
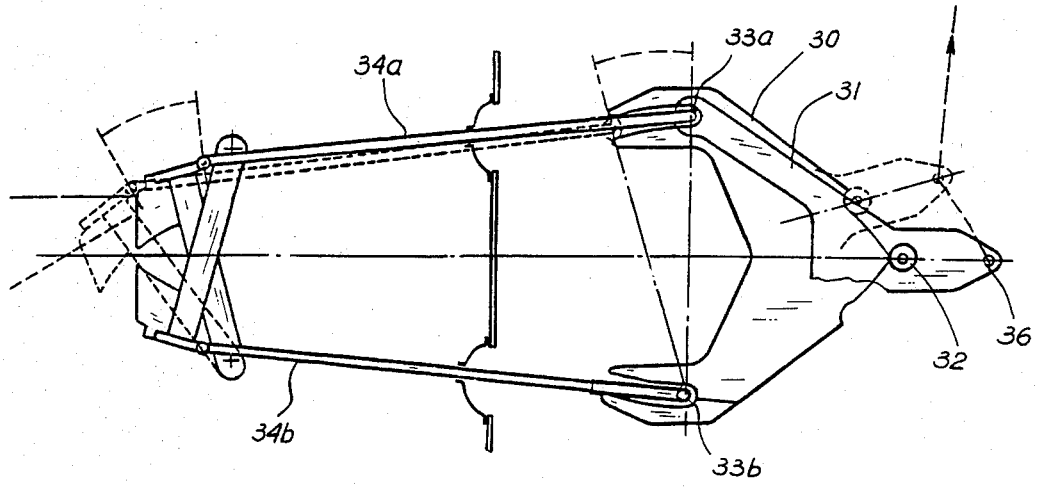
FIG. 9 is a top view of the either/or operating mechanism in FIG. 8 and the steering deflectors with one arm of the steering lever deleted for clarification.

FIG. 8 is a sectional view and FIG. 9 is a plan of an either/or mechanism with steering deflectors but with part of one arm of the steering lever deleted for clarity. In dash outline the relative positions of the steering lever and push-rod are shown when steering to starboard.

The guide plate 30 is stationary and is mounted on the casing of the jet propulsion unit. The steering lever 31 is Y shaped and has two similar members 31(*a*) and 31(*b*) above and below the guide plate and carrying the guide roller 32 between them. The pivot pins 33(*a*), 33(*b*) carry the push-rods 34(*a*), 34(*b*). Slide pads 35 near the pivot pins and near the guide roller support the Y shaped steering lever. Each push-rod 34(*a*) and 34(*b*) has a forked end to facilitate mounting at the pivot pins 33(*a*) and 33(*b*). The Y shaped steering lever 31 has a connecting pin 36 to which the hydraulic cylinder or other operating device may be attached. This gives the action as above described and ensures one deflector is totally withdrawn before the other deflector is caused to be activated.

This is a particularly efficient means of ensuring that there is an either/or operation for the deflectors and by providing an either/or mechanism according to the present invention and appropriate connecting means it is possible to gang a plurality of jet units to operate together with the deflectors being completely synchronised and with only one control cylinder for example, a push pull cylinder operating towards one side of the ganged units.

With the present invention it may also be advantageous to slightly restrict the cross-sectional area of the discharge nozzle at certain times. This can be affected by moving both steering deflectors simultaneously a small distance towards engagement with the jetstream. Such action can be used to reduce the quantity of water discharge and this in turn will tend to reduce the tendency of the pump to cavitate. This tendency can occur when a large input of power is used to accelerate the craft when the speed of the craft is still relatively low. At such times there is often insufficient ram pressure generated at the intake of the pump and cavitation can occur unless the volume of discharge is reduced by restricting the discharge nozzle. As the speed of the craft rises and sufficient ram pressure is generated the steering deflectors can be moved away from the jet stream allowing the discharge area to be increased to its normal size.

With regard to the either/or mechanism above described if this assembly was on a slide which could relative to the body be moved forwardly and rearwardly the deflectors could be caused to move together to form the restriction on the nozzle side without in any way impairing the steering action of the deflectors. Thus an operator could be provided with an additional control so that the power and speed of the craft could be related to the control mechanism which is used to restrict the size of the discharged nozzle. In this way the unit could be used at higher power even at low speed.

It will be apparent from the foregoing disclosure that the control means as described involves various mechanisms which can be used in combination or separately.

What is claimed is:

1. Hydraulic jet propulsion apparatus incorporating steering means comprising two steering deflectors diametrically opposed and operable to deflect horizontally in either direction a jetstream emerging from a discharge nozzle, each said steering deflector being pivotally mounted, each pivot being located adjacent to the discharge nozzle but forward of the mergence of the jetstream from the discharge nozzle and on the opposite side of the discharge nozzle to the deflector with the inner surface of each deflector (on the side adjacent to the jetstream) being a surface of revolution about an axis which is close to the pivot axis for the deflector and a control mechanism to control of the movement of said steering deflectors so that only one steering deflector is moved into the path of the jetstream at a time while the other steering deflector remains stationary or nearly stationary and clear of the jetstream and the steering deflector acting upon the jetstream has totally withdrawn before the other steering deflector is activated.

2. Hydraulic jet propulsion apparatus incorporating steering means comprising two steering deflectors diametrically opposed and operable to deflect horizontally in either direction a jetstream emerging from a discharge nozzle, each said steering deflector being pivotally mounted, each pivot being located adjacent to the discharge nozzle but forward of the mergence of the jetstream from the discharge nozzle and on the opposite side of the discharge nozzle to the deflector with the inner surface of each deflector (on the side adjacent to the jetstream) being a surface of revolution about an axis which coincides with the pivot axis for the deflector and a control mechanism to control the movement of said steering deflectors so that only one steering deflector is moved into the path of the jetstream at a time while the other steering deflector remains stationary or nearly stationary and clear of the jetstream and the steering deflector acting upon the jetstream has totally withdrawn before the other steering deflector is activated.

3. Hydraulic jet propulsion apparatus as claimed in claims 1 or 2 wherein each steering deflector is supported on a pair of arms, one above the discharge nozzle and one below the discharge nozzle and extending from the steering deflector to its associated pivot each such pair of arms crossing the other such pair of arms.

4. Hydraulic jet propulsion apparatus as claimed in claims 1 or 2 wherein the said steering deflectors are used in association with a flexible seal adjacent to the emergence of the jetstream from the discharge nozzle so as to reduce or eliminate any back flow of water between the discharge nozzle and the said steering deflectors.

5. Hydraulic jet propulsion apparatus as claimed in claims 1 or 2 in which the discharge nozzle has a case of a rigid material and an interior liner of a flexible material, the flexible material extending downstream of the rigid case, each said steering deflector bearing against the said flexible liner downstream of the rigid case at such times as said steering deflector operates so as to deflect the jetstream.

6. Hydraulic jet propulsion apparatus as claimed in claims 1 or 2 wherein the shape of the said surface of revolution in vertical section through its axis of revolution is similar to the shape of the jetstream in cross-section as it emerges from the discharge nozzle and the steering deflector encloses approximately half of the perimeter of the jetstream.

7. Hydraulic jet propulsion apparatus as claimed in claims 1 or 2 wherein said control mechanism includes an either or mechanism incorporating a glide plate which carries a steering lever, such guide plate having two separated pivot points and two intersecting arcuate profiles each centered on a pivot point, each pivot point being the centre of the rounded end of a slot in the guide plate, said steering lever having two pivot pins adapted such that they will simultaneously lie in the said rounded ends of the slots when the steering lever is in its central position, a guide roller attached to said steering lever and adapted so as to engage one or other of the arcuate profiles when the steering lever is moved pivotally about one or other of the pivot points away from its central position, said steering lever having attachment points for push-rods adjacent to the said pivot pins and push-rods adapted to operate the steering deflectors.

* * * * *